US008826599B2

(12) United States Patent
Stahl, Jr.

(10) Patent No.: US 8,826,599 B2
(45) Date of Patent: Sep. 9, 2014

(54) INSULATING GASKET CONSTRUCTION FOR HEAD-OF-WALL JOINTS

(71) Applicant: Specified Technologies Inc., Somerville, NJ (US)

(72) Inventor: James P. Stahl, Jr., Princeton Junction, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 13/694,766

(22) Filed: Jan. 2, 2013

(65) Prior Publication Data

US 2013/0205694 A1 Aug. 15, 2013

Related U.S. Application Data

(60) Provisional application No. 61/633,416, filed on Feb. 10, 2012, provisional application No. 61/686,038, filed on Mar. 29, 2012.

(51) Int. Cl.

| | |
|---|---|
| ***E04H 9/00*** | (2006.01) |
| ***E04B 1/94*** | (2006.01) |
| ***E04B 1/84*** | (2006.01) |

(52) U.S. Cl.
CPC .. *E04B 1/941* (2013.01); *E04B 1/84* (2013.01)
USPC ..... 52/1; 52/232; 52/317

(58) Field of Classification Search
USPC ..... 52/1, 232, 317
See application file for complete search history.

(56) References Cited

U.S. PATENT DOCUMENTS

| | | | | |
|---|---|---|---|---|
| 3,324,615 | A * | 6/1967 | Zinn | 52/241 |
| 5,010,702 | A | 4/1991 | Daw et al. | |
| 5,127,203 | A | 7/1992 | Paquette | |
| 5,755,066 | A | 5/1998 | Becker | |
| 5,913,788 | A | 6/1999 | Herren | |
| 5,921,041 | A | 7/1999 | Egvi, II | |
| 5,950,385 | A | 9/1999 | Herren | |
| 6,058,668 | A | 5/2000 | Herren | |
| 6,176,053 | B1 | 1/2001 | St. Germain | |
| 6,647,691 | B2 * | 11/2003 | Becker et al. | 52/656.1 |
| 6,783,345 | B2 | 8/2004 | Morgan et al. | |
| 6,997,026 | B2 * | 2/2006 | Fischer | 72/181 |
| 7,043,880 | B2 | 5/2006 | Morgan et al. | |
| 7,152,385 | B2 | 12/2006 | Morgan et al. | |
| 7,240,905 | B1 | 7/2007 | Stahl, Sr. | |
| 7,617,643 | B2 | 11/2009 | Pilz et al. | |
| 7,681,365 | B2 * | 3/2010 | Klein | 52/232 |
| 7,752,817 | B2 | 7/2010 | Pilz et al. | |
| 7,814,718 | B2 | 10/2010 | Klein | |
| 7,866,108 | B2 | 1/2011 | Klein | |
| 7,950,198 | B2 | 5/2011 | Pilz et al. | |

(Continued)

*Primary Examiner* — Elizabeth A Plummer
(74) *Attorney, Agent, or Firm* — Sperry, Zoda & Kane

(57) ABSTRACT

A head-of-wall joint for insulating the intersection between a wall assembly and the bottom of a floor or roof construction thereabove which utilizes an insulating gasket of a unique shape and construction positioned between the ceiling track and the point of intersection thereof with respect to the upper building floor or roof structure. The configuration of the insulating gasket member includes a main section and two side sections which extend over the outwardly facing surfaces of a conventionally configured ceiling track or runner without being attached to the ceiling track side panel side surfaces. The gasket can included tabs to attach to the lowermost edges of the track side sections. The gasket can be made from acoustically insulating materials or firestopping materials, or both.

17 Claims, 6 Drawing Sheets

(56) References Cited

U.S. PATENT DOCUMENTS

| | | | | |
|---|---|---|---|---|
| 8,132,376 | B2 * | 3/2012 | Pilz et al. | 52/207 |
| 8,281,552 | B2 * | 10/2012 | Pilz et al. | 52/846 |
| 8,322,094 | B2 * | 12/2012 | Pilz et al. | 52/232 |
| 8,353,139 | B2 * | 1/2013 | Pilz et al. | 52/232 |
| 8,590,231 | B2 * | 11/2013 | Pilz | 52/232 |
| 2006/0137293 | A1 | 6/2006 | Klein | |
| 2007/0011971 | A1 * | 1/2007 | Sitkiewicz | 52/481.1 |
| 2007/0209306 | A1 * | 9/2007 | Andrews et al. | 52/317 |
| 2009/0090074 | A1 | 4/2009 | Klein | |
| 2009/0126304 | A1 * | 5/2009 | Sareyka et al. | 52/481.1 |
| 2009/0178363 | A1 | 7/2009 | Pilz et al. | |
| 2009/0223159 | A1 | 9/2009 | Colon | |
| 2010/0126092 | A1 | 5/2010 | Pilz et al. | |
| 2011/0011019 | A1 | 1/2011 | Stahl, Jr. et al. | |
| 2011/0113709 | A1 | 5/2011 | Pilz et al. | |
| 2011/0185656 | A1 | 8/2011 | Klein | |
| 2011/0214371 | A1 | 9/2011 | Klein | |
| 2011/0247281 | A1 | 10/2011 | Pilz et al. | |
| 2012/0066989 | A1 * | 3/2012 | Pilz et al. | 52/232 |
| 2013/0031856 | A1 * | 2/2013 | Pilz et al. | 52/232 |

* cited by examiner

INSULATING GASKET CONSTRUCTION FOR HEAD-OF-WALL JOINTS

The present utility application hereby formally claims priority of U.S. Provisional Patent application No. 61/633,416 filed Feb. 10, 2012 on "CONSTRUCTION FOR FIRESTOPPING HEAD-OF-WALL JOINTS" filed by the same inventor listed herein, namely, James P. Stahl, Jr and assigned to the same assignee as the present patent application, namely, Specified Technologies Inc.; said referenced provisional patent application is hereby formally incorporated by reference as an integral part of the present application.

The present utility application also hereby formally claims priority of U.S. Provisional Patent application No. 61/686,038 filed Mar. 29, 2012 on "CONSTRUCTION FOR FIRESTOPPING HEAD-OF-WALL JOINTS" filed by the same inventor listed herein, namely, James P. Stahl, Jr and assigned to the same assignee as the present patent application, namely, Specified Technologies Inc.; said referenced provisional patent application is hereby formally incorporated by reference as an integral part of the present application.

BACKGROUND OF THE INVENTION

1. Field of the Invention

The present invention deals generally with the field of acoustical or firestopping insulating including, possibly, intumescent or felt-type material components. In the prior art various means were utilized for the purposes of achieving insulation of head-of-wall joints but all have been proved to be inadequate. For example, traditionally mineral wool has been installed or coatings or sealants have been applied in these in these areas for achieving firestop sealing and for acoustical sealing various different materials have been used to prevent sound transmission. Also, the use of tape having an intumescent component has been applied to the side downwardly extending flanges of the track for firestopping. These systems include various important disadvantages. Such prior art heat-of wall insulating attempts have required an extensive amount of manual labor at the job site. Also, with the use of insulating tape and other similar constructions. the metal tracks often require a unique construction on the exterior surface of the metal track which can have a predefined area such as a recess or the like which identifies the specific location required for placement of such an intumescent and/or acoustic layer of insulation material such as tape. One of the advantages of the apparatus of the present invention is that it is usable with conventionally OEM metal track construction and does not require any customized design for the ceiling runner, primarily, because these present construction works best when not attached in any manner to the track side surfaces sections particularly where it is important to allow for some amount relative movement therebetween during normal expansion and contraction of building materials and sections which occurs commonly.

In particular, as the joint moves responsive to normal expansion and contraction of the building components, the insulating tape and/or the coatings of insulating material which is attaché directly to the surfaces of the downwardly extending side sections of the ceiling track can become dislodged from components of the head-of-wall area, that is, particularly dislodging from the surfaces of the downwardly extending side sections of the track or runner. Also these systems do not specifically address variations in the contour or profile of the ceiling or roof area which comes into direct abutment with the upper portion of the metal track. Such variations in the configuration of the building construction in this area can form gaps between the track and the adjacent roof or ceiling area which are not adequately addressed for insulation by the above described prior art systems.

2. Description of the Prior Art

Many patents have been granted for various constructions for insulating head-of-wall joints such as shown in U.S. Pat. No. 5,010,702 patented Apr. 30, 1991 to T. L. Daw et al and assigned to Daw Technologies, Inc. on a "Modular Wall System"; and U.S. Pat. No. 5,127,203 patented Jul. 7, 1992 to R. F. Paquette on a "Seismic/Fire Resistant Wall Structure and Method"; and U.S. Pat. No. 5,755,066 patented May 26, 1998 to D. W. Becker on a "Slip Track Assembly; and U.S. Pat. No. 5,913,788 patented Jun. 22, 1999 to T. R. Herren on a "Fire Blocking And Seismic Resistant Wall Structure"; and U.S. Pat. No. 5,921,041 patented Jul. 13, 1999 to J. D. Egri, II on a "Bottom Track For Wall Assembly"; and U.S. Pat. No. 5,950,385 patented Sep. 14, 1999 to T. R. Herren on an "Interior Shaft Wall Construction"; and U.S. Pat. No. 6,058,668 patented May 9, 2000 to 0T. R. Herren on a "Seismic And Fire-Resistant Head-of-Wall Structure"; and U.S. Pat. No. 6,176,053 patented Jan. 23, 2001 to Roger C. A. St. Germain and assigned to Robert C. A. St. Germain on a "Wall Track Assembly And Method For Installing The Same"; and U.S. Pat. No. 6,783,345 patented Aug. 31, 2004 to M. D. Morgan et al and assigned to W.R. Grace & Co.-Conn on "In Situ Molded Thermal Barriers"; and U.S. Pat. No. 7,043,880 patented May 16, 2006 to M. D. Morgan et al and assigned to W.R. Grace & Co.-Conn. on "In Situ Molded Thermal Barriers"; and U.S. Patent Publication No. 2006/0137293 published Jun. 29, 2006 to J. A. Klein on "Head-Of-Wall Fireblocks And Related Wall Assemblies"; and U.S. Pat. No. 7,152,385 patented Dec. 26, 2006 to M. D. Morgan et al and assigned to W.R. Grace & Co.-Conn. on "In Situ Molded Thermal Barriers"; and U.S. Pat. No. 7,240,905 patented Jul. 10, 2007 to J. P. Stahl, Sr. and assigned to Specified Technologies, Inc. on a "Method And Apparatus For Sealing A Joint Gap Between Two Independently Movable Structural Substrates"; and U.S. Patent Publication No. 2009/0090074 published Apr. 9, 2009 to J. A. Klein on "Head-Of-Wall Fireblock Systems And Related Wall Assemblies"; and U.S. Patent Publication No. 2009/0178363 published Jul. 16, 2009 to D. A. Pilz et al and assigned to California Expanded Metal Products Company on an "Exterior Wall Construction Product"; and U.S. Patent Publication No. 2009/0223159 published Sep. 10, 2009 to Mark Colon on a "Fire Block And Thermal Barrier System For Fluted Metal Decks"; and U.S. Pat. No. 7,617,643 patented Nov. 17, 2009 to D. A. Pilz et al and assigned to California Expanded Metal Products Company on a "Fire-Rated Wall Construction Product"; and U.S. Pat. No. 7,681,365 patented Mar. 23, 2010 to J. A. Klein on "Head-Of-Wall Fireblock Systems And Related Wall Assemblies"; and U.S. Patent Publication No. 2010/0126092 published May 27, 2010 to D. A. Pilz et al on a "Fire-Rated Wall Construction Product"; and U.S. Pat. No. 7,752,817 patented Jul. 13, 2010 to D. A. Pilz et al and assigned to California Expanded Metal Products Company on a "Two-Piece Track System"; and U.S. Pat. No. 7,814,718 patented Oct. 19, 2010 to J. A. Klein on "Head-Of-Wall Fireblocks"; and U.S. Pat. No. 7,866,108 patented Jan. 11, 2011 to J. A. Klein on "Head-Of-Wall Fireblock Systems And Related Wall Assemblies"; and U.S. Patent Publication No. 2011/0011019 published Jan. 20, 2011 on a "Firestopping Sealing Means For Use With Gypsum Wallboard In Head-Of-Wall Construction"; and U.S. Patent Publication No. 2011/0113709 published May 19, 2011 to D. A. Pilz et al and assigned to California Expanded Metal Products Company on a "Wall Gap Fire Block Device, System and Method"; and U.S. Pat. No. 7,950, 198 patented May 31, 2011 to D. A. Pilz et al and assigned to California Expanded Metal Products Company on a "Fire-Rated Wall Construction Product"; and U.S. Patent Publication No. 2011/0185656 published Aug. 4, 2011 to J. A. Klein on a "Fire Retardant Cover For Fluted Roof Deck"; and U.S. Patent Publication No. 2011/0214371 published Sep. 8, 2011 on an "Offset Leg Framing Element For Fire Stop Applications"; and U.S. Patent Publication No. 2011/0247281 published Oct. 13, 2011 to D. A. Pilz et al and assigned to California Expanded Metal Products Company on a "Fire-Rated Wall Construction Product".

SUMMARY OF THE INVENTION

The present invention provides an insulating gasket construction for sealing a head-of-wall area between the ceiling thereabove and a wall assembly therebeneath. This wall assembly will include a ceiling track having a generally horizontally extending main track with a first track side section extending downwardly therefrom and a second side track section extending downwardly therefrom at a position spatially disposed from the first track section. The main track, the first track and the second track define therebetween a frame receiving area which is of an inverted C-shaped configuration. This frame receiving area is defined to receive the wall assembly mounted therewithin. The insulating gasket construction includes a main gasket section which is at least partially made of an insulating material and which extends generally horizontally and is positioned in direct abutment with respect to the main track of the ceiling track and extends thereabove. The first track side section is at least partially made of insulating material and extends downwardly from the main track section to extend over the first track side section of the ceiling track.

Similarly a second gasket side section is at least partially made of insulating material and extends downwardly from the main gasket section and is spatially disposed from the first gasket side section to extend over the second track side section of the ceiling track. The main gasket section along with the first gasket side section and the second gasket side section will together define a track receiving area therebeneath which is generally C-shaped in configuration and faces downwardly therefrom and is adapted to receive the ceiling track therewithin. Preferably the main gasket section and the first and second gasket side sections are integrally formed with respect to one another.

The insulating gasket construction can be made partially from a firestopping insulating material which could be an intumescent firestopping material. It also can be made solely from an acoustical insulating material for applications where sound transmissions are found to be desirable. Such acoustical insulating configurations can preferably be formed of a felt acoustically insulating material. It is also possible for the insulating gasket construction of the present invention to have components of both firestopping and acoustical sealing therewithin and with such configurations firestopping can be provided by an intumescent component and acoustical sealing can be provided by a felt material all in the same construction.

In one configuration the first side gasket section will include at least one first tab extending inwardly therefrom into the track receiving area which is positionable in engagement with the lowermost edge of the first side track for attachment of the first gasket side section adjacent thereto and wherein the second gasket side section includes at least one second tab extending inwardly therefrom into the track receiving area which is positionable in engagement with the second lowermost edge of the second track side section for attachment of the second gasket side section adjacent thereto. These tabs preferably are formed by punching semi-circular slits or cuts in the material of the side section to allow the tabs to extend inwardly therefrom into the track receiving area defined therewithin.

The gasket side section can be spatially disposed outwardly from the first track side to the define a first track therebetween and a second gasket side section can be spatially disposed outward from the second track side to define a second track therebetween. Furthermore a fastener can be provided positionable extending vertical outwardly through the main track section of the ceiling track and through the main gasket section of the insulation gasket construction into the ceiling thereabove to affix the insulating gasket construction and the ceiling track with respect to the head-of-wall area simultaneously.

In one of the preferred configurations of the present invention the first gasket side section will extend downwardly and outwardly with respect to the main gasket section at an outwardly splayed angle of greater than 90 degrees with respect to one another. Similarly the second gasket side section will extend downwardly and outwardly with respect to the main gasket section at an outwardly splayed angle of greater than 90 degrees with respect thereto.

It is an object of the construction for insulating head-of-wall joints of the present invention to effectively seal between conventionally designed metal track sections and the immediately adjacent roof or ceiling area for firestopping and/or acoustic insulating thereof.

It is an object of the construction for insulating head-of-wall joints of the present invention to be usable with conventional steel framing and gypsum board wall constructions.

It is an object of the construction for insulating head-of-wall joints of the present invention to be usable with floor or roof constructions of any conventional construction including solid concrete or a composite material installed atop a corrugated steel deck.

It is an object of the construction for insulating head-of-wall joints of the present invention to prevent the spread of sound, noise, fire, super-heated gases, flames and/or smoke in these areas.

It is an object of the construction for acoustical and/or thermal insulating head-of-wall joints of the present invention to provide more effective insulating by providing attachment of the insulating material to the metal track only in the central upper portion thereof or at the lowermost edges of the track side walls without any attachment whatsoever to the surfaces of the downwardly extending track side sections to facilitate insulating therearound irrespective of the normal expansion and contraction of building structural components that take place over the time period prior to the occurrence of the fire conditions.

It is an object of the construction for insulating head-of-wall joints of the present invention to minimize costs and maintenance requirements.

It is an object of the construction for insulating head-of-wall joints of the present invention to expedite installation and minimize labor costs.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
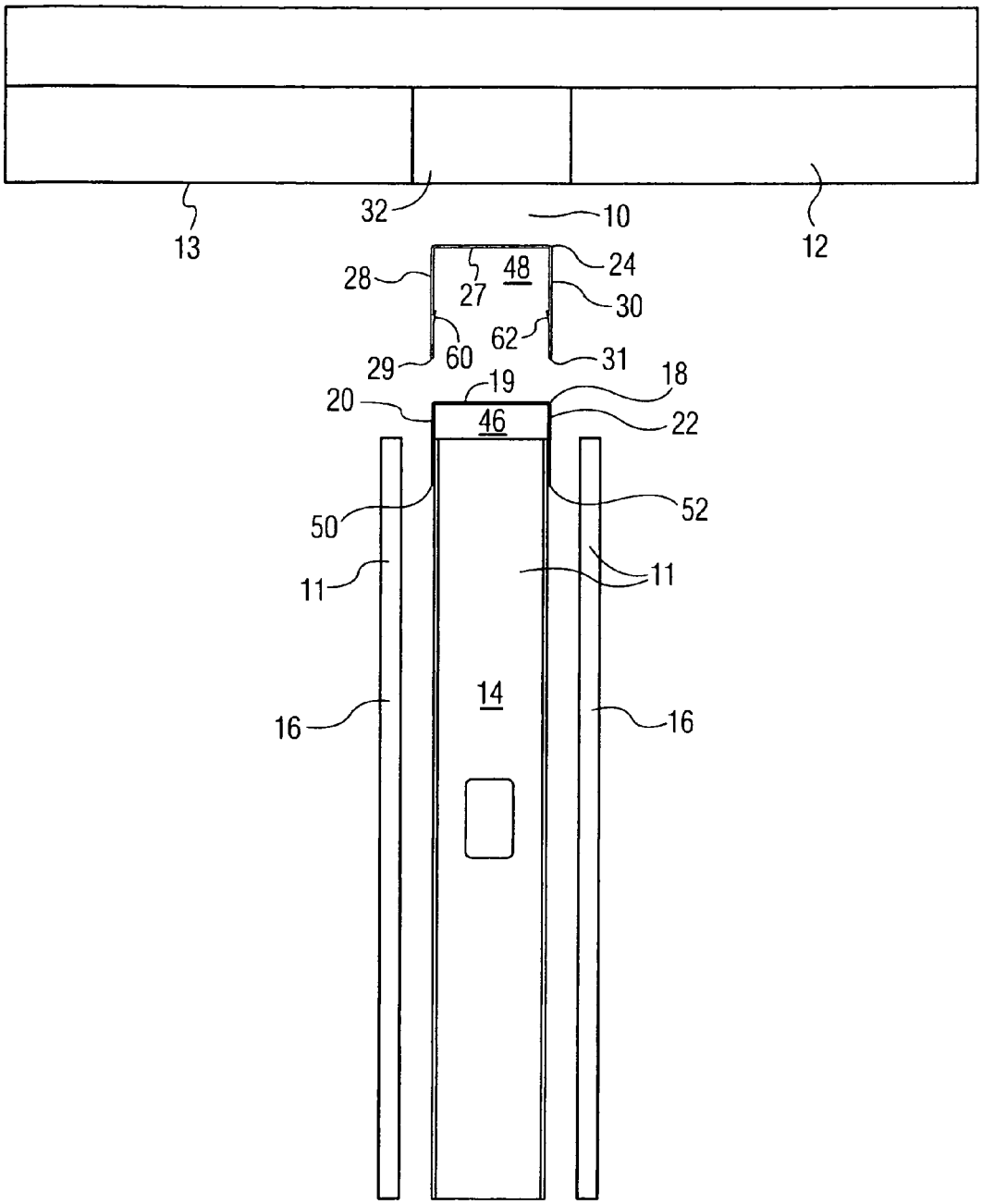
FIG. 1 is a exploded front plan view of the completed assembly showing an embodiment of the gasket of the present invention positioned between the metal track or runner and the bottom of a floor thereabove.

The present invention discloses an insulating gasket 24 usable positioned adjacent to the head-of-wall joint 10 of a conventional building construction for insulating sealing thereof which can be acoustically insulating or can be firestopping. If configured for firestopping, the insulating gasket 24 may include a firestopping material which may be intumescent. If configured for acoustic insulating the insulating gasket 24 will include an acoustically insulating material therewithin. For either of these two purposes, the insulating gasket 24 will be positioned between the upper building structure of a floor or roof 12 and a wall assembly 11 therebelow which may be fire-rated or may have a need for acoustical insulation. Such wall assemblies 11 usually include steel framing members or studs 14 with gypsum board 16 mounted thereupon and extending vertically therewith.

A ceiling track or runner 18 is secured to the bottom area 13 of the upper building structure floor or roof 12 conventionally such that it is adapted to receive the framing members 14 positioned therewithin for maintaining attachment therebetween. The ceiling track 18 preferably includes a main track section 19 which normally extends approximately horizontally and a first track side section 20 extending approximately vertically downwardly therefrom and a second track side section 22 extending approximately vertically downward therefrom at a position spatially disposed from the first track side section 20. In this manner a framing receiving area 46 is defined between the first track side section 20 and the second track side section 22 into which the upper portion of the steel framing studs 14 extend.

The insulating gasket 24 of the present invention will preferably be formed as a paper product having significant flexibility and will include at least one component which provides the intumescence firestopping insulation or if acoustic will preferably include a felt material to minimize sound transmissions therethrough. With either construction the insulating material will be particularly flexible. However, in the present invention enhanced strength or reinforcement of the material can be provided by including a reinforcing facing member 26 on one side of the insulating gasket member 24 of polyethylene material or other similar material. For example, an inner facing reinforcing member can be positioned extending over the gasket insulating section 56 facing the ceiling track 18. However it is preferable to provide an outer facing reinforcing member 55 which comprises a layer extending over the surface of the gasket insulating section 56 facing outwardly away from the ceiling track 18. It should be appreciated that although this reinforcing facing member 26 can be applied on the outwardly facing portion of the insulating gasket member 24 or the inwardly facing portion that, preferably, it is positioned on the outwardly facing surface, particularly when aesthetic considerations are of a concern.

Figure 2:
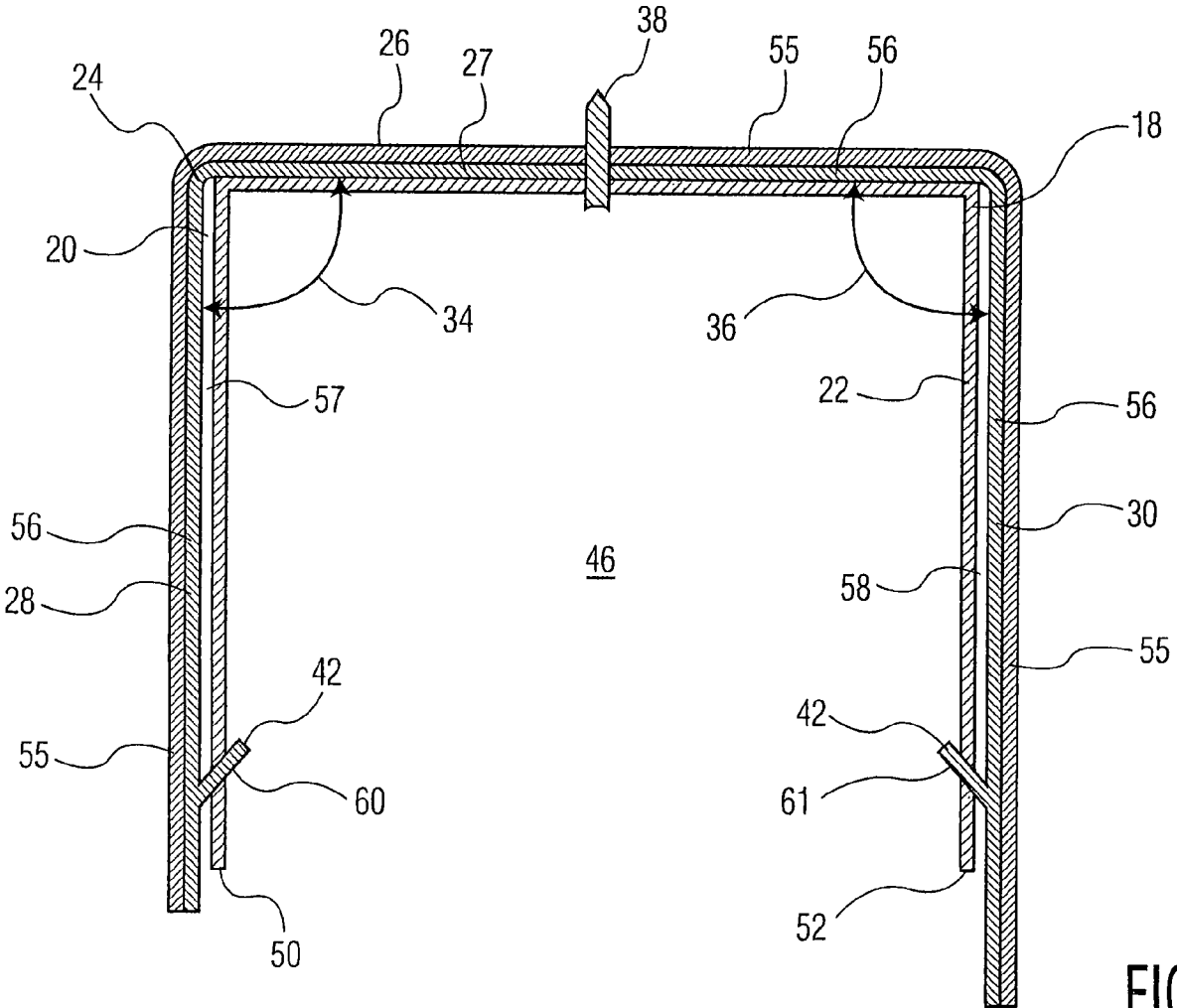
FIG. 2 is side cross-sectional view of an embodiment of the insulating gasket of the present invention shown in position engaged to and receiving a ceiling track therewithin.
Figure 3:
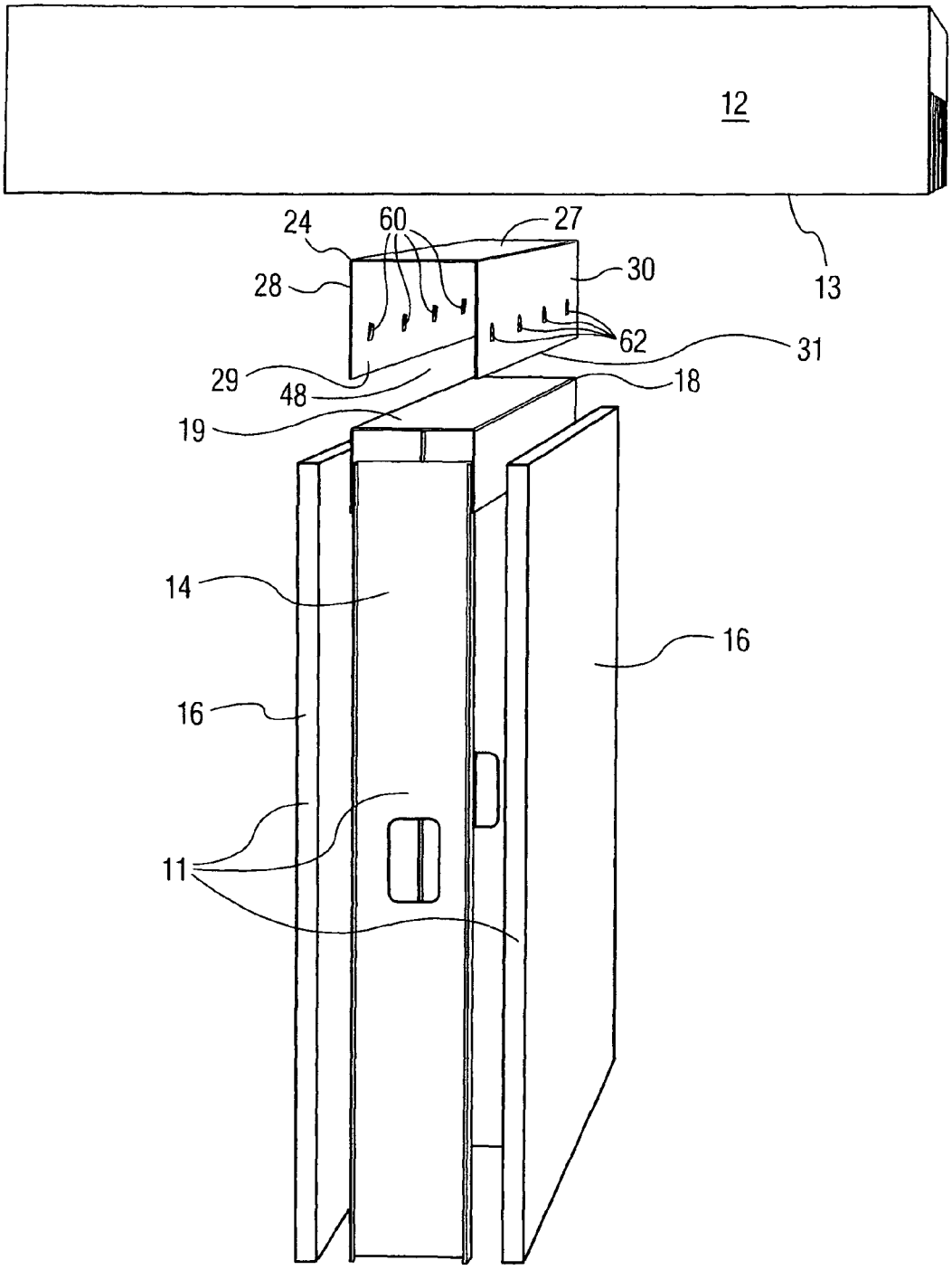
FIG. 3 is an exploded perspective illustration of the embodiment shown in FIG. 1.
Figure 4:
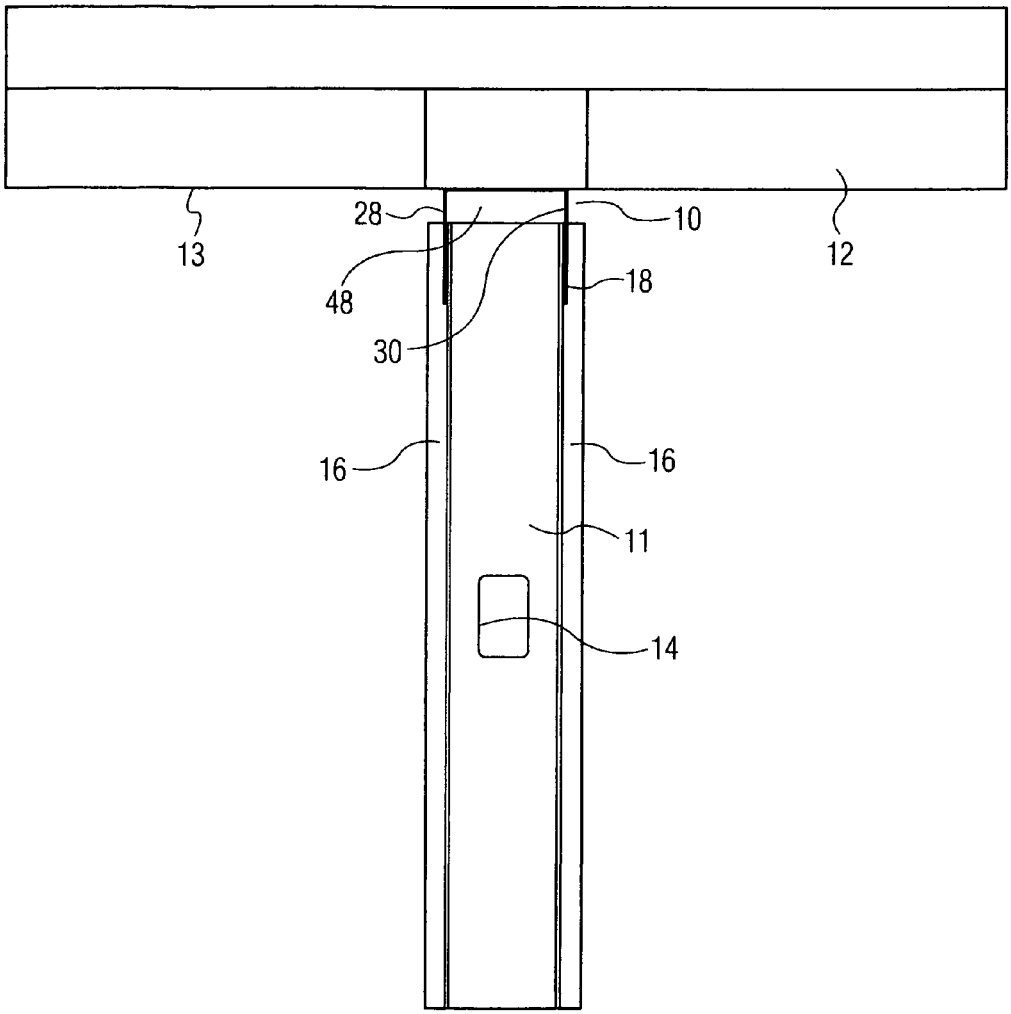
FIG. 4 is front plan view of the embodiment shown in FIG. 1 with the insulating gasket partially installed.
Figure 5:
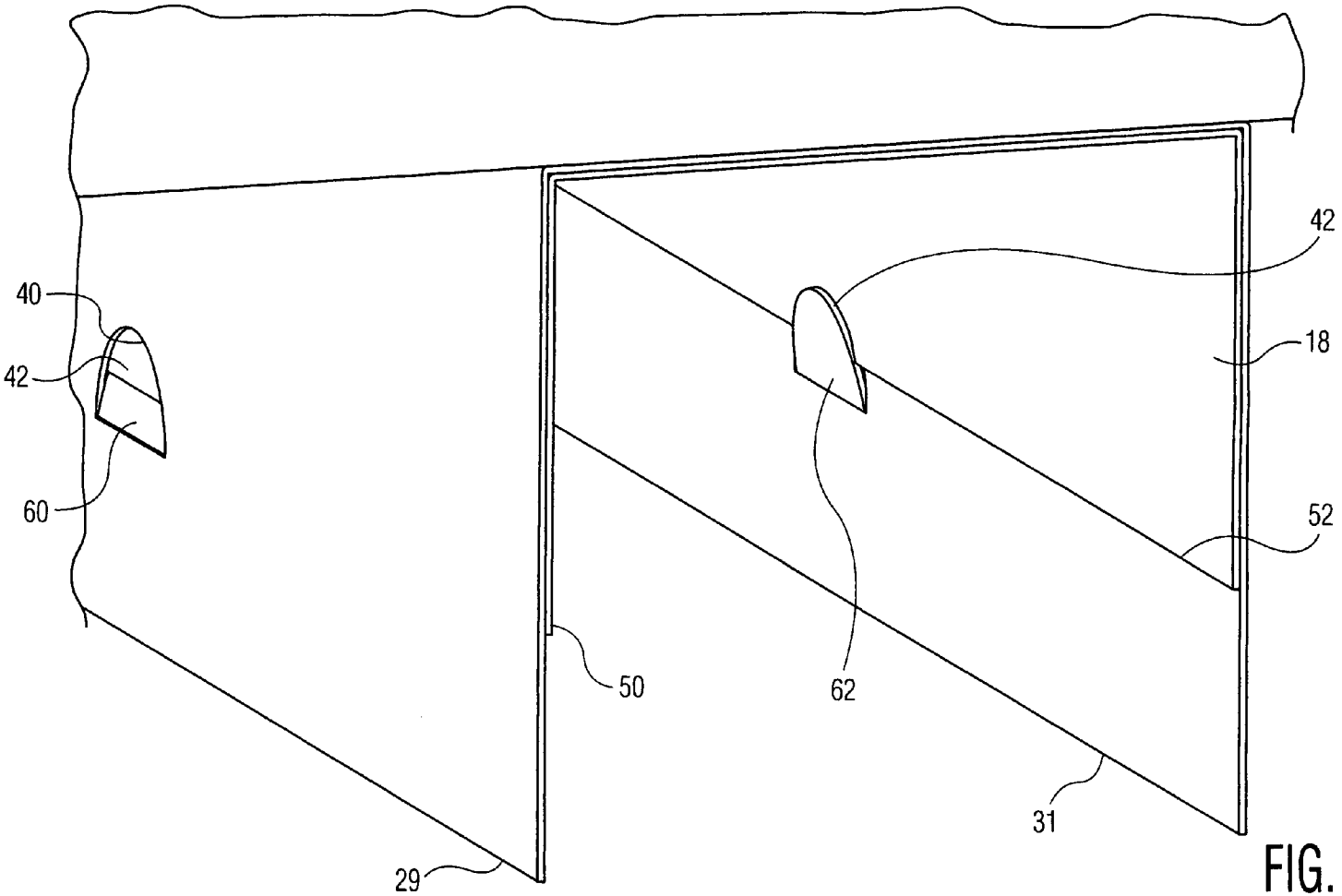
FIG. 5 is a perspective illustration from above showing an embodiment of the present invention showing an enlarged view of the gasket of the present invention illustrating the engaging of the tabs with respect to the lowermost edges of the track side sections.
Figure 6:
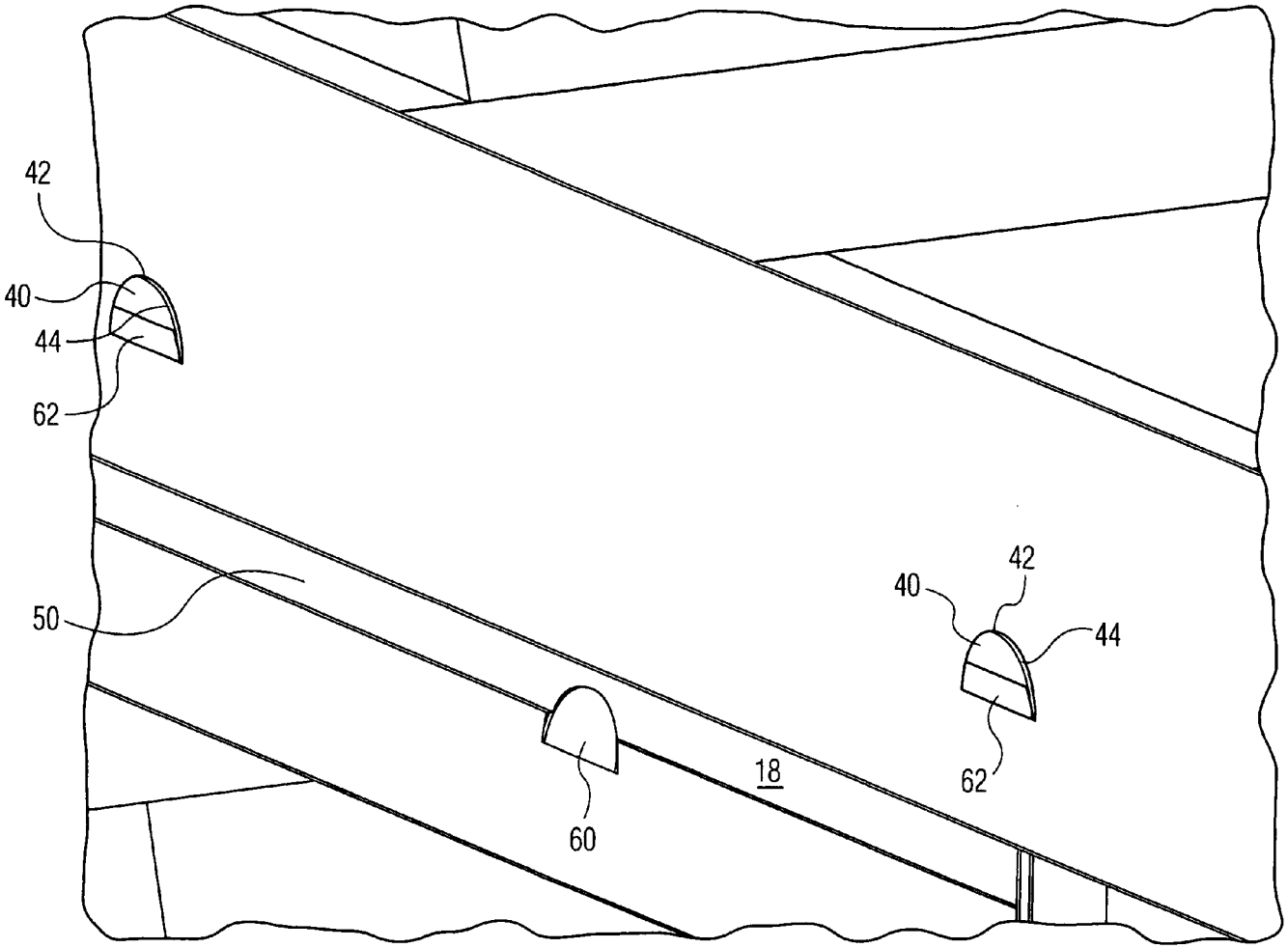
FIG. 6 is a perspective illustration from below showing an embodiment of the present invention showing an enlarged view of the gasket of the present invention illustrating the engaging of the tabs with respect to the lowermost edges of the track side sections.

The construction of the insulating gasket 24 is similar to the overall construction of the ceiling track or runner 18 since it includes a main gasket section 27 extending generally horizontally with a first gasket side section 28 extending vertically downwardly on one side thereof and a second gasket side section 30 extending vertically downward on the opposite side thereof. The first and second gasket side sections 28 and 30 will be spaced apart from one another to define therebetween a track receiving area 48 for receiving of the ceiling track 18 of a similar complementary shape positioned therewithin. With this configuration the main gasket section 27 will extend generally horizontally at a position immediately above the main track section 19 of ceiling track 18. Also, the first gasket side section 28 will extend generally vertically downwardly at a position immediately adjacent to and extending over the first track side section 20. Similarly, the second gasket side section 30 will extend generally vertically downwardly at a position extending adjacent to and over the outwardly facing surface of the second track section 22. This mated configuration between the insulating gasket 24 and the ceiling track 18 is best shown in FIGS. 2 and 4.

To facilitate positioning of the generally U-shaped ceiling track 18 within track receiving area 48 of the U-shaped insulating gasket 24, the insulating gasket 24 will preferably be constructed with the first side gasket section 28 and the second side gasket section 30 outwardly splayed from the main gasket section 28. That is, first gasket side section 28 will preferably extend vertically downwardly and outwardly from the main gasket section 27 at an outwardly splayed angle 34 which is greater than 90 degrees and less than 180, to be obtuse. Similarly the section gasket side section 30 will extend generally vertically downwardly and outwardly from the main gasket section 27 at an obtuse or outwardly splayed angle 36 therebetween. In this manner the U-shaped track receiving area 48 of the insulating gasket 24 will have an outwardly splayed U-shape shape for facilitating receiving of the ceiling track 18 thereinto. Thus, it will much easier for installation persons to position of the insulating gasket 24 in surrounding engagement with respect to the ceiling track 18 with the main track section 19, the first side track section 20 and the second track side section 22 easily positioned within track receiving area 48.

It should be appreciated that one of the advantages of the construction of the present invention is that the outwardly splayed angle 34 of first gasket side section 28 relative to the main gasket section 27 will inherently define a first gap 57 between the first gasket side section 28 and the first track side section 20 located thereadjacent. Similarly, the outwardly splayed angle 36 of second gasket side section 30 relative to the main gasket section 27 will inherently define a second gap 58 between the second gasket side section 30 and the second track side section 22 located thereadjacent. This spacing created by the first gap 57 and the second gap 58 between the insulating gasket member 24 and the first gasket side section 20 and the second gasket side section 22, respectively, has been found to greatly enhance the firestopping and acoustical insulating characteristics thereof.

In most prior art constructions the ceiling tracks or runners 18 are attached directly to the bottom 13 of the upper building floor or roof structure 12 by the use of fasteners 38 such as staples, nails, screws or other penetrating fastening members usually made of steel. The positioning of this fastener is best shown in FIG. 2. It is important consideration of the present invention to appreciate that when an insulating gasket 24 is positioned in surrounding relationship with respect to a ceiling track or runner 18 prior to affixing of the track 18 to the bottom 13 of the upper building structure 12, then attachment to the upper building structure 12 thereof is performed in the conventional manner by placement of such penetrating fasteners 38 in engagement with and usually extending through the insulating gasket 24 simultaneously with placing thereof through the ceiling track 18 which allows attachment to be made without requiring any additional labor expense of time and/or effort. That is, normally such fasteners 38 penetrate through the main track section 19 of a ceiling track 18 for securement of the ceiling track 18 to the bottom 13 of the upper building structure 12. The conventional labor process for making this attachment will, thusly, also attach the insulating gasket 24 in proper position without requiring any additional labor effort. This is a very important aspect of the present invention because it minimizes costs by not increasing the labor time for installation when installing the insulating gasket of the present invention. Furthermore, it is very important to consider that this manner of attachment will allow both the first gasket side section 28 and the second gasket side section 30 to move freely over the outer surfaces of the downwardly extending first track side section 20 and second track side section 22 because there is no attachment therebetween and because they are initially splayed slightly outwardly at greater than 90 degrees. The absence of direct attachment between first track side section 20 and first gasket side section 28 as well as the lack of direct attachment between the second track side section 22 and the second gasket side section 30 allows this freedom of movement while still maintaining the gasket side sections 28 and 30 at positions adjacent the respective trackside section 20 and 22 while still positioning the gasket side sections 28 and 30 extending generally thereover to facilitate insulating when needed.

Commonly such head-of-wall structures include an open area immediately above the track 18 as shown in FIGS. 1 and 2. These areas will be maintained as being sealed by firestopping pillows 32 as shown in FIGS. 1 and 4 usually primarily comprise mineral wool material. It should be particularly appreciated that the insulating gasket 24 can include any one of a wide variety of different insulating materials. The preferential insulating component for this gasket member 24 would be an intumescent material for firestopping. However, many other insulating materials would be effective for firestopping depending somewhat upon the construction and materials with which the apparatus of the present invention is used. It is only necessary that the insulation component be exposed to the area in the vicinity of the head-of-wall area.

Furthermore, the insulating gasket of the present invention can be made with an acoustic insulating version component which may or may not include a firestopping component. For example, another different insulating material that could be used would be felt-type material that could be similarly strengthened by a reinforcing facing member 26 preferably positioned as an outer reinforcing facing member 55 preferably of a polyethylene material. The use of felt material in the gasket insulation section 56 of the insulating gasket 24 would be advantageous because it would provide unique acoustic properties that would enhance the acoustic insulating characteristics of the gasket of the present invention. Because of the lack of structural strength in such felt material, use would usually require an outer reinforcing member 55 as shown best in FIG. 2 to fully strengthen the gasket insulation section 56.

An additional means of securement is provided by the inclusion of attachment tabs 42 defined formed in the first and second gasket side sections 28 and 30 by forming side perforations 40 along each of the gasket side sections 28 and 30. The preferred construction for providing these attachment tabs 42 is by making a semi-circular cut line 44 preferably by a semicircular-shaped punch which is arcuate in the upper portion and is generally C-shaped and faces downwardly toward the lower edges 29 and 31 of the first and second gasket side sections 28 and 30, respectively, to form the attachment tabs 42 facing upwardly therefrom. Preferably the location of each of these punched sections will form an attachment tab 42 of the gasket material centrally located within the C-shaped punch which will be spaced upwardly from the first lower edge 29 of first gasket side section 28 and will be spaced upwardly from the second lower edge 31 of the second gasket side section 30. Each of the first tabs 60 and the second tabs 61 will extending inwardly from the first gasket side section 28 and second gasket side section 30 into the frame receiving area 46. In this manner the first gasket side section 28 will extend around and be attached with respect to the first lowermost edge 50 of the first track side section and the second gasket side section 30 will extend around and be attached to the second lowermost edge 52 second track side section 22. The attachment tabs 42 defined in the first gasket side section 28 are referenced herein as the first tabs 60. The attachment tabs 42 defined in the second gasket side section 30 are referenced herein as the second tabs 60. Tabs 60 will extend downwardly beneath the first lowermost edge 50 of first track side section 20. Tabs 61 will extend downwardly beneath the second lowermost edge 52 of second track side section 22. Neither of the track side sections 20 and 22 will be otherwise secured with respect to the vertically extending surface of either of the track side sections 20 and 22. Thus, effective positioning of the first and second gasket side sections 28 and 30 can be achieved without requiring any expansive securement thereof onto the surfaces of the main track side sections 20 and 22. That is, the securement will be to the first and second lowermost edges 50 and 52 of the track side sections 20 and 22, respectively, rather than onto any portion of the expansive surfaces thereof.

Preferably there will be a plurality of such first attachment tabs 60 positioned along the longitudinally extending length of the first gasket side section 28 and a plurality of such second attachment tabs 61 positioned along the longitudinally extending length of the second gasket side sections 30 to achieve effective attachment thereto.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. An insulating gasket construction for sealing a head-of-wall area between a ceiling thereabove and a wall assembly therebelow which includes a ceiling track having a generally horizontally oriented main track with a first track side section extending downwardly therefrom and a second side track section extend downwardly therefrom at a position spatially disposed from the first track section wherein the first track side section defines a first lowermost edge and the second side track section defines a second lowermost edge, the first track section and the second track section together with the main track defining a frame receiving area which is C-shaped and oriented facing downwardly therefrom to be adapted to receive the wall assembly mounted therewithin, said insulating gasket construction comprising:

A. main gasket section which is at least partially made of insulating material and which extends generally horizontally and is positioned in direct abutment with respect to the main track of the ceiling track and extending thereabove;

B. first gasket side section which is at least partially made of insulating material and which extends downwardly from said main gasket section to extend over the first track side section of the ceiling track, said first gasket side section including at least one first tab extending inwardly therefrom into said track receiving area which is positionable in engagement with the first lowermost edge of the first track side section for attachment of said first gasket side section adjacent thereto, said first tab being located at an intermediate position vertically along said first gasket side section to assure insulating over the first track side section completely downwardly to the first lowermost edge thereof; and C. second gasket side section which is at least partially made of insulating material and which extends downwardly from said main gasket section spatially disposed from said first gasket side section to extend over the second track side section of the ceiling track, said main gasket section and said first gasket side section and said second gasket side section together defining a track receiving area therebetween to receive the ceiling track therewithin, said second gasket side section including at least one second tab extending inwardly therefrom into said track receiving area which is positionable in engagement with the second lowermost edge of the second track side section for attachment of said second gasket side section adjacent thereto, said second tab being located at an intermediate position vertically along said second gasket side section to assure insulating over the second track side section completely downwardly to the first lowermost edge thereof.

2. An insulating gasket construction for sealing a head-of-wall area as defined in claim 1 wherein said main gasket section, said first gasket side section and said second gasket side section are made at least partially from a firestopping insulating material.

3. An insulating gasket construction for sealing a head-of-wall area as defined in claim 2 wherein said main gasket section, said first gasket side section and said second gasket side section are made at least partially from an intumescent firestopping insulating material.

4. An insulating gasket construction for sealing a head-of-wall area as defined in claim 1 wherein said main gasket section, said first gasket side section and said second gasket side section are made at least partially from an acoustically insulating material.

5. An insulating gasket construction for sealing a head-of-wall area as defined in claim 1 wherein said main gasket section, said first gasket side section and said second gasket side section are made at least partially from a felt acoustically insulating material.

6. An insulating gasket construction for sealing a head-of-wall area as defined in claim 1 wherein said main gasket section, said first gasket side section and said second gasket side section are made at least partially from a firestopping insulating material and are made at least partially from an acoustically insulating material.

7. An insulating gasket construction for sealing a head-of-wall area as defined in claim 1 wherein said main gasket section is integrally formed with respect to said first gasket side section and said second gasket side section.

8. An insulating gasket construction for sealing a head-of-wall area as defined in claim 1 wherein said first gasket side section defines at least one first arcuate cut-line therein to define each of said first tabs which are extendible into said track receiving area and wherein said second gasket side section defines at least one second arcuate cut-line therein to define each of said second tabs which are extendible into said track receiving area.

9. An insulating gasket construction for sealing a head-of-wall area as defined in claim 8 wherein each of said first arcuate cut-lines and each of said second arcuate cut-lines are semicircular in shape.

10. An insulating gasket construction for sealing a head-of-wall area as defined in claim 9 wherein said first tabs are hemispherically-shaped and wherein said second tabs are hemispherically-shaped.

11. An insulating gasket construction for sealing a head-of-wall area as defined in claim 1 wherein said first gasket side section is spatially disposed outwardly from the first track side section to define a first gap therebetween and wherein said second gasket side section is spatially disposed outwardly from the second track side section to define a second gap therebetween.

12. An insulating gasket construction for sealing a head-of-wall area as defined in claim 1 wherein said first gasket side section is spatially disposed outwardly away from the first gasket side section except where said first tab engages the first gasket side section and wherein said second gasket side section is spatially disposed outwardly away from the second gasket side section except where said second tab engages the second gasket side section.

13. An insulating gasket construction for sealing a head-of-wall area as defined in claim 1 further comprising a fastener means positionable extending vertically upwardly through the main track section of the ceiling track and through said main gasket section of said insulating gasket construction into the ceiling thereabove to affix said insulating gasket construction and the ceiling track with respect thereto within the head-of-wall area.

14. An insulating gasket construction for sealing a head-of-wall area as defined in claim 1 wherein said first gasket side section extends downwardly and outwardly with respect to said main gasket section at an outwardly splayed angle of greater than 90 degrees with respect thereto and wherein said second gasket side section extends downwardly and outwardly with respect to the main gasket section at an outwardly splayed angle of greater than 90 degrees with respect thereto.

15. An insulating gasket construction for sealing a head-of-wall area as defined in claim 1 further comprising a reinforcing facing member extending over said main gasket section, said first gasket side section and said second gasket side section for facilitating strengthening thereof.

16. An insulating gasket construction for sealing a head-of-wall area as defined in claim 15 wherein said reinforcing facing member is of a polyethylene material.

17. An insulating gasket construction for sealing a head-of-wall area as defined in claim 1 wherein said first gasket side section is spatially disposed outwardly from the first track side section to define a first gap therebetween and wherein said second gasket side section is spatially disposed outwardly from the second track side section to define a second gap therebetween, said first track side section being spatially disposed from the surface of the first track side section and attached only to the first lowermost edge of the first track side section, said second track side section being spatially disposed from the surface of the second track side section and attached only to the second lowermost edge of the second track side section.

* * * * *